US008096781B2

(12) United States Patent
Nelson et al.

(10) Patent No.: US 8,096,781 B2
(45) Date of Patent: Jan. 17, 2012

(54) HYDRAULIC PUMP SYSTEM WITH REDUCED COLD START PARASITIC LOSS

(75) Inventors: Bryan E. Nelson, Lacon, IL (US); Kirat Shah, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 515 days.

(21) Appl. No.: 12/236,772

(22) Filed: Sep. 24, 2008

(65) Prior Publication Data

US 2010/0074767 A1 Mar. 25, 2010

(51) Int. Cl.
*F04B 39/02* (2006.01)

(52) U.S. Cl. ..... 417/228

(58) Field of Classification Search ..... 417/228, 417/222.1; 92/153, 154, 156; 60/486
See application file for complete search history.

(56) References Cited

U.S. PATENT DOCUMENTS

| | | | | |
|---|---|---|---|---|
| 1,422,902 | A | | 7/1922 | Thomas |
| 3,522,999 | A | | 8/1970 | Liles |
| 3,698,839 | A | | 10/1972 | Distefano |
| 3,834,836 | A | | 9/1974 | Hein et al. |
| 3,873,239 | A | | 3/1975 | Jamieson |
| 3,889,709 | A | | 6/1975 | Dwyer |
| 4,017,221 | A | | 4/1977 | Dezelan |
| 4,129,986 | A | | 12/1978 | Heinrich |
| 4,211,256 | A | | 7/1980 | Sturtz, Jr. |
| 4,226,270 | A | | 10/1980 | Sturtz, Jr. et al. |
| 4,249,558 | A | | 2/1981 | Clifford et al. |
| 4,525,129 | A | | 6/1985 | Berges et al. |
| 4,702,083 | A | | 10/1987 | Nakamura et al. |
| 4,951,466 | A | | 8/1990 | Macht |
| 4,972,762 | A | | 11/1990 | Kubik |
| 5,251,440 | A | | 10/1993 | Bong-dong et al. |
| 5,339,776 | A | | 8/1994 | Regueiro |
| 5,410,878 | A | | 5/1995 | Lee et al. |
| 5,419,130 | A | * | 5/1995 | Ruckgauer et al. ..... 60/456 |
| 5,456,078 | A | | 10/1995 | Goloff |
| 5,990,800 | A | | 11/1999 | Tamaki et al. |
| 6,397,590 | B1 | | 6/2002 | Hart |
| 6,453,668 | B1 | | 9/2002 | Johnson |
| 6,655,135 | B2 | | 12/2003 | Oka |
| 6,672,285 | B2 | | 1/2004 | Smith et al. |
| 2006/0021340 | A1 | | 2/2006 | Vigholm et al. |
| 2006/0191732 | A1 | | 8/2006 | Lunzman et al. |

FOREIGN PATENT DOCUMENTS

JP 2002-310064 * 10/2002

* cited by examiner

*Primary Examiner* — Devon C Kramer
*Assistant Examiner* — Bryan Lettman
(74) *Attorney, Agent, or Firm* — Leydig, Voit & Mayer

(57) ABSTRACT

A machine hydraulic pump system including at least one hydraulic pump driven to pressurize hydraulic fluid. A drain port is in fluid communication with an interior lubricating cavity of the pump. A selectively activatable flow control member is in flow-controlling relation to the drain port. The selectively activatable flow control member is adapted to move from a fluid containment condition to a fluid withdrawal condition prior to activation of the pump to at least partially evacuate lubricating liquid from the interior of the pump in response to the temperature of the lubricating liquid dropping below a predefined lower limit.

20 Claims, 5 Drawing Sheets

HYDRAULIC PUMP SYSTEM WITH REDUCED COLD START PARASITIC LOSS

TECHNICAL FIELD

The present disclosure relates generally to a machine hydraulic pump system, and more particularly, to a machine hydraulic pump system incorporating pump casing drainage at low temperatures to reduce parasitic losses during startup.

BACKGROUND

Hydraulic machines such as, for example, dozers, loaders, excavators, motor graders, and other types of heavy equipment, use one or more hydraulic actuators to accomplish a variety of tasks. These actuators are fluidly connected to hydraulic pumps on the machine that provide pressurized fluid to chambers within the actuators. The hydraulic pumps force pressurized fluid to move into or through the chambers such that the pressure of the fluid acts on hydraulic surfaces of the chambers to move the actuator and/or a connected work tool. When the pressurized fluid is drained from the chambers it is returned to a fluid storage tank on the machine for reuse.

One problem associated with this type of hydraulic arrangement involves starting of the machine when temperatures are low. Specifically, as the starter is activated to crank the engine and to start the hydraulic pumps, the starter is required to overcome the drag torque of the engine and the pumps. One component of the drag torque of the pumps is due to the displacement provided by the pump as fluid is moved from the storage tank to the hydraulic actuators. Another component of the drag torque of the pumps is due to the drag on rotating groups or elements or other moving parts within the pump caused by fluid which is not being pumped but which fills the pump casing to provide lubrication. The drag torque of the pumps may be particularly high when the hydraulic fluid is at low temperature due to the enhanced viscosity of the hydraulic fluid being pumped and filling the pump case in surrounding relation to moving parts. Thus, a system to reduce drag torque of the hydraulic pumps in cold conditions may be useful.

Prior practices used to reduce the torque drag of the hydraulic pumps typically have focused on adjustment of the pump displacement to reduce initial torque drag during start-up. One such practice is described in U.S. Pat. No. 3,522,999 issued to Liles on Aug. 4, 1970. Specifically, this patent describes the use of a bypass valve to direct fluid being pumped from the high pressure outlet side of the system to the low pressure inlet side of the system until the engine reaches its idling speed and the temperature of hydraulic fluid exceeds a defined level. While this approach may provide benefits in reducing torque drag, it does so by reducing the initial effective output of the pump.

The disclosed hydraulic pump system is directed to overcoming one or more of the problems set forth above and/or other problems of the prior art.

SUMMARY OF THE INVENTION

One aspect of the present disclosure is directed to a machine hydraulic pump system. The machine hydraulic pump system may include at least one hydraulic pump driven to pressurize hydraulic fluid. The pump includes a pump casing defining an interior cavity adapted to hold a lubricating liquid. At least one drain port is in fluid communication with the interior cavity. A selectively activatable flow control member is disposed in operative relation to the drain port. The selectively activatable flow control member is adapted to move from a fluid containment condition to a fluid withdrawal condition in response to the temperature of the lubricating liquid dropping below a predefined lower limit to at least partially evacuate the lubricating liquid from the interior cavity prior to startup of the hydraulic pump.

Another aspect of the present disclosure is directed to a method of reducing torque drag during start-up of a hydraulic pump in a machine hydraulic pump system having at least one pump driven to pressurize hydraulic fluid. The pump includes a pump casing defining an interior cavity adapted to hold a lubricating liquid. The pump includes at least one drain port in fluid communication with the interior cavity. A flow control member disposed in flow-controlling relation to the drain port is selectively moved from a fluid containment condition to a fluid withdrawal condition prior to startup of the hydraulic pump to at least partially evacuate the lubricating liquid from the interior cavity. The hydraulic pump is started without replacing the lubricating liquid evacuated from the pump casing.

DETAILED DESCRIPTION

Figure 1:
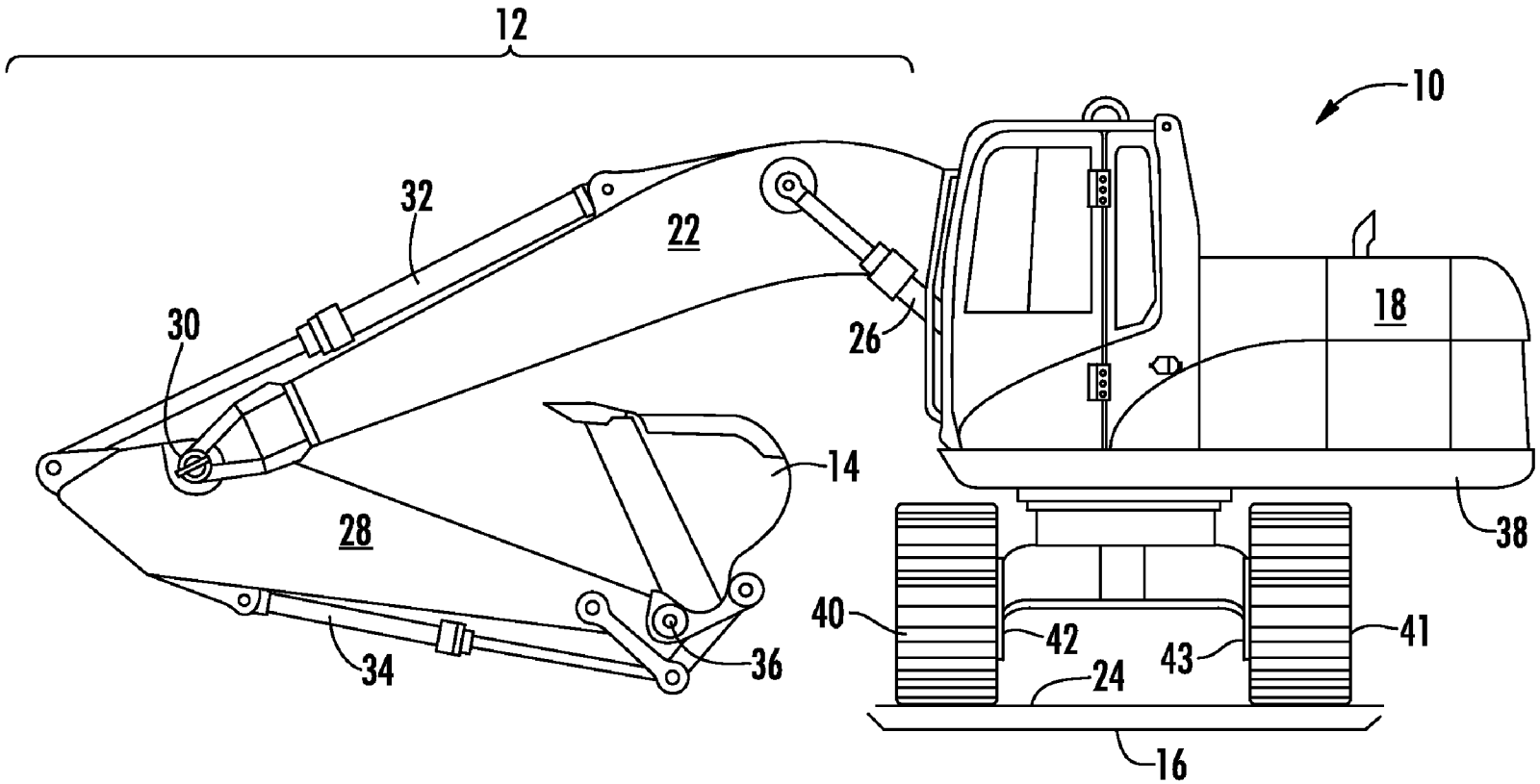
FIG. 1 is a side-view diagrammatic illustration of an exemplary disclosed machine.

FIG. 1 illustrates an exemplary machine 10 having multiple systems and components that cooperate to accomplish a task. The machine 10 may embody a fixed or mobile machine that performs some type of operation associated with an industry such as mining, construction, farming, transportation, or any other industry known in the art. For example, the machine 10 may be an earth moving machine such as an excavator, a dozer, a loader, a backhoe, a motor grader, a dump truck, or any other earth moving machine. The machine 10 may include an implement system 12 configured to move a work tool 14, a drive system 16 for propelling the machine 10, and a power source 18 that provides power to the implement system 12 and the drive system 16.

The implement system 12 may include a linkage structure acted on by fluid actuators to move the work tool 14. Specifically, the implement system 12 may include a boom member 22 vertically pivotal about a horizontal axis (not shown) relative to a work surface 24 by a pair or adjacent, double-acting, hydraulic cylinders 26 (only one shown in FIG. 1). The implement system 12 may also include a stick member 28 vertically pivotal about a horizontal axis 30 by a double-acting, hydraulic cylinder 32. Implement system 12 may further include a double-acting, hydraulic cylinder 34 operatively connected to the work tool 14 to pivot the work tool 14 vertically about a horizontal pivot axis 36. The boom member 22 may be pivotally connected to a frame 38 of the machine 10.

Numerous different work tools 14 may be attachable to a single machine 10 and controllable by an operator of the machine 10. In this regard, the work tool 14 may include any device used to perform a particular task as, for example, a bucket, a fork arrangement, a blade, a shovel, a ripper, a dump bed, a broom, a snow blower, a propelling device, a cutting device a grasping device, or any other task-performing device as may be desired. Although connected in the embodiment of FIG. 1 to pivot relative to the machine 10, the work tool 14 may alternatively or additionally rotate, slide, swing, lift, or move in any other known manner.

The drive system 16 may include one or more traction devices used to propel the machine 10. In one example, the drive system 16 includes a first track 40 located on one side of the machine 10, and a second track 41 located on an opposing side of the machine 10. The first track 40 may be driven by a first travel motor 42, while the second track 41 may be driven by a second travel motor 43. It is contemplated that the drive system 16 may include traction devices other than tracks such as wheels, belts, or other known traction devices, if desired.

The first travel motor 42 and/or the second travel motor 43 may be driven by creating a fluid pressure differential. Specifically, the first travel motor 42 and the second travel motor 43 may include first and second chambers (not shown) located to either side of an impeller (not shown). When the first chamber is filled with pressurized fluid and the second chamber is drained of fluid, the impeller may be urged to rotate in a first direction. Conversely, when the first chamber is drained of the fluid and the second chamber is filled with the pressurized fluid, the respective impeller may be urged to rotate in a second direction opposite the first direction. The flow rate of fluid into and out of the first and second chambers may relate to a rotational velocity of the travel motors while a pressure differential between the travel motors may relate to a torque.

The power source 18 may embody an engine such as, for example, a diesel engine, a gasoline engine, a gaseous fuel-powered engine, or any other type of combustion engine known in the art. It is contemplated that power source 18 may alternatively embody a non-combustion source of power such as a fuel cell, a power storage device, or another suitable source. Power source 18 may produce a mechanical or electrical power output that may then be converted to hydraulic power for moving the various hydraulic cylinders and the travel motors.

Figure 2:
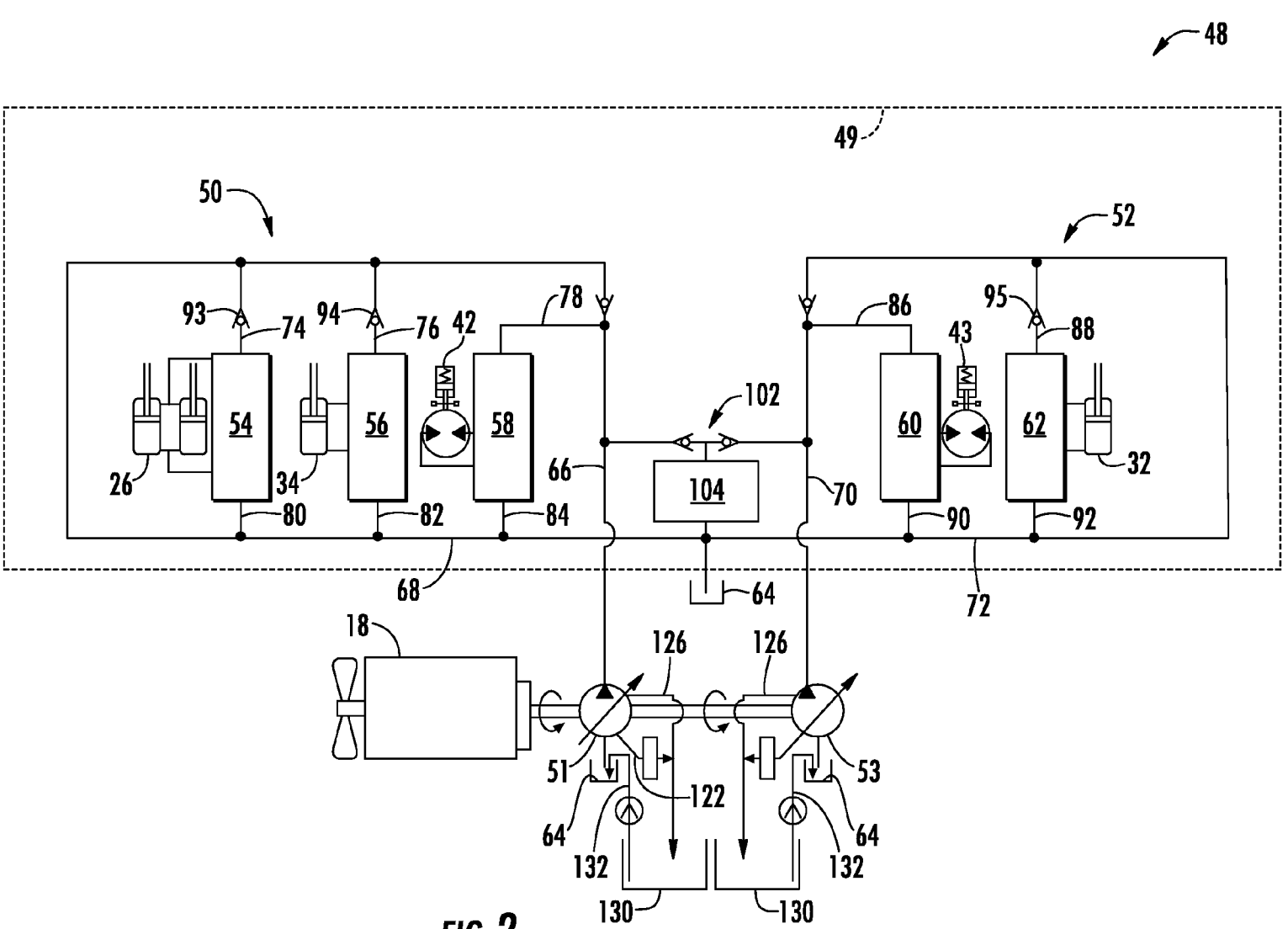
FIG. 2 is a schematic illustration of an exemplary disclosed machine control system that may be used with the machine of FIG. 1.

As illustrated in FIG. 2, the machine 10 may include a machine control system 48 having a plurality of fluid components that cooperate to move the work tool 14 and the machine 10. In particular, the machine control system 48 may include a valve stack 49 at least partially forming a first circuit 50 adapted to receive a first stream of pressurized fluid from a first hydraulic pump 51, and a second circuit 52 adapted to receive a second stream of pressurized fluid from a second hydraulic pump 53. The first hydraulic pump 51 and the second hydraulic pump 52 may be similar or dissimilar. The first hydraulic pump 51 and the second hydraulic pump 52 may be rotating piston pumps although other pump constructions such as vane pumps and the like may be used if desired.

By way of example only, the first circuit 50 may include a boom control valve 54, a bucket control valve 56, and a left travel control valve 58 connected to receive the first stream of pressurized fluid in parallel. The second circuit 52 may include a right travel control valve 60 and a stick control valve 62 connected to receive the second stream of pressurized fluid in parallel. It is contemplated that a greater number, a lesser number, or a different configuration of valve mechanisms may be included within the first circuit 50 and/or the second circuit 52, if desired.

The first hydraulic pump 51 and the second hydraulic pump 53 may draw fluid from one or more tanks 64 and pressurize the fluid to predetermined levels. The first hydraulic pump 51 and the second hydraulic pump 53 may each be separately and driveably connected to a rotation output from the power source 18 of the machine 10 by, for example, a countershaft, a belt, an electrical circuit, or in any other suitable manner. Alternatively, each of the first hydraulic pump 51 and the second hydraulic pump 53 may be indirectly connected to the power source 18 via a torque converter, a reduction gear box, or in any other suitable manner. It is contemplated that only a single hydraulic pump may alternatively provide pressurized fluid to both the first circuit 50 and the second circuit 52, if desired.

The tanks 64 may constitute a low-pressure reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to the tank 64. Although the machine control system 48 is illustrated as being connected to multiple separate fluid tanks, the machine control system 48 may likewise be connected to a single tank if desired.

Each of the boom control valve 54, the bucket control valve 56, the left travel control valve 58 the right travel control valve 60 and the stick control valve 62 may regulate the motion of their associated fluid actuators. Specifically, boom control valve 54 may have elements movable to control the motion of the hydraulic cylinders 26 associated with the boom member 22, the bucket control valve 56 may have elements movable to control the motion of the hydraulic cylinder 34 associated with the work tool 14, and the stick control valve 62 may have elements movable to control the motion of hydraulic cylinder 32 associated with stick member 28. Likewise, the left travel control valve 58 may have valve elements movable to control the motion of the first travel motor 42, while the right travel control valve 60 may have elements movable to control the motion of second travel motor 43.

The control valves of the first circuit 50 and the second circuit 52 may be connected to regulate flows of pressurized fluid to and from the respective actuators via common passages. Specifically, the control valves of the first circuit 50 may be connected to the first hydraulic pump 51 by way of a first common supply passage 66 that extends along one side of the valve stack 49, and to the tank 64 by way of a first common drain passage 68 extending along a side of the valve stack 49 opposite the first common supply passage 66. Similarly, the control valves of the second circuit 52 may be connected to the second hydraulic pump 53 by way of a second common supply passage 70 that extends along one side of the valve stack 49, and to the tank 64 by way of a second common drain passage 72 that extends along a side of the valve stack 49 opposite the second common supply passage 70. The boom control valve 54, the bucket control valve 56, and the left travel control valve 58 may be connected in parallel to the first common supply passage 66 by way of a first individual fluid passage 74, a second individual fluid passage 76, and a third individual fluid passage 78, respectively, and in parallel to the first common drain passage 68 by way of a fourth individual fluid passage 80, a fifth individual fluid passage 82, and a sixth individual fluid passage 84, respectively. Similarly, the right travel control valve 60 and the stick control valve 62 may be connected in parallel to the second common supply passage 70 by way of a seventh individual fluid passage 86 and an eighth individual fluid passage 88, respectively, and in parallel to the second common drain passage 72 by way of a ninth individual fluid passage 90 and a tenth individual fluid passage 92, respectively. A first check valve 93 may be disposed within the first individual fluid passage 74. A second check valves 94 may be disposed within the second individual fluid passage 76. A third check valve 95 may be disposed within the eighth individual fluid passage 80 to provide for a unidirectional supply of pressurized fluid to the boom control valve 54, the bucket control valve 56, and the stick control valve 62, respectively.

Because the elements of the boom control valve 54, the bucket control valve 56, the left travel control valve 58, the right travel control valve 60 and the stick control valve 62 may be similar and function in a related manner, only the operation of the boom control valve 54 will be discussed in this disclosure. In one example, the boom control valve 54 may include a first chamber supply element (not shown), a first chamber drain element (not shown), a second chamber supply element (not shown), and a second chamber drain element (not shown). The first and second chamber supply elements may be connected in parallel with the first individual fluid passage 74 to fill their respective chambers with fluid from the first hydraulic pump 51, while the first and second chamber drain elements may be connected in parallel with the fourth individual fluid passage 80 to drain the respective chambers of fluid. By way of example, to extend the hydraulic cylinders 26, the first chamber supply element may be moved to allow the pressurized fluid from the first hydraulic pump 51 to fill the first chambers of the hydraulic cylinders 26 with pressurized fluid via the first individual fluid passage 74, while the second chamber drain element may be moved to drain fluid from the second chambers of the hydraulic cylinders 26 to the tank 64 via the fourth individual fluid passage 80. To move the hydraulic cylinders 26 in the opposite direction, the second chamber supply element may be moved to fill the second chambers of the hydraulic cylinders 26 with pressurized fluid, while the first chamber drain element may be moved to drain fluid from the first chambers of the hydraulic cylinders 26. It is contemplated that both the supply and drain functions may alternatively be performed by a single element associated with the first chamber and a single element associated with the second chamber, or by a single valve that controls all filling and draining functions.

The supply and drain passages of the first circuit 50 and the second circuit 52 may be interconnected for relief functions. In particular, the first common drain passage 68 and the second common drain passage 72 may relieve fluid from the first circuit 50 and the second circuit 52 to the tank 64 during normal operation. However, as fluid within the first circuit 50 and the second circuit 52 exceeds a maximum acceptable pressure level, fluid from the circuit having the excessive pressure may also drain to the tank 64 by way of a shuttle valve 102, and a common main relief element 104. It is contemplated that the first common supply passage 66 and the second common supply passage 70 of the first circuit 50 and the second circuit 52 may likewise be interconnected for makeup functions, if desired.

Figure 3:
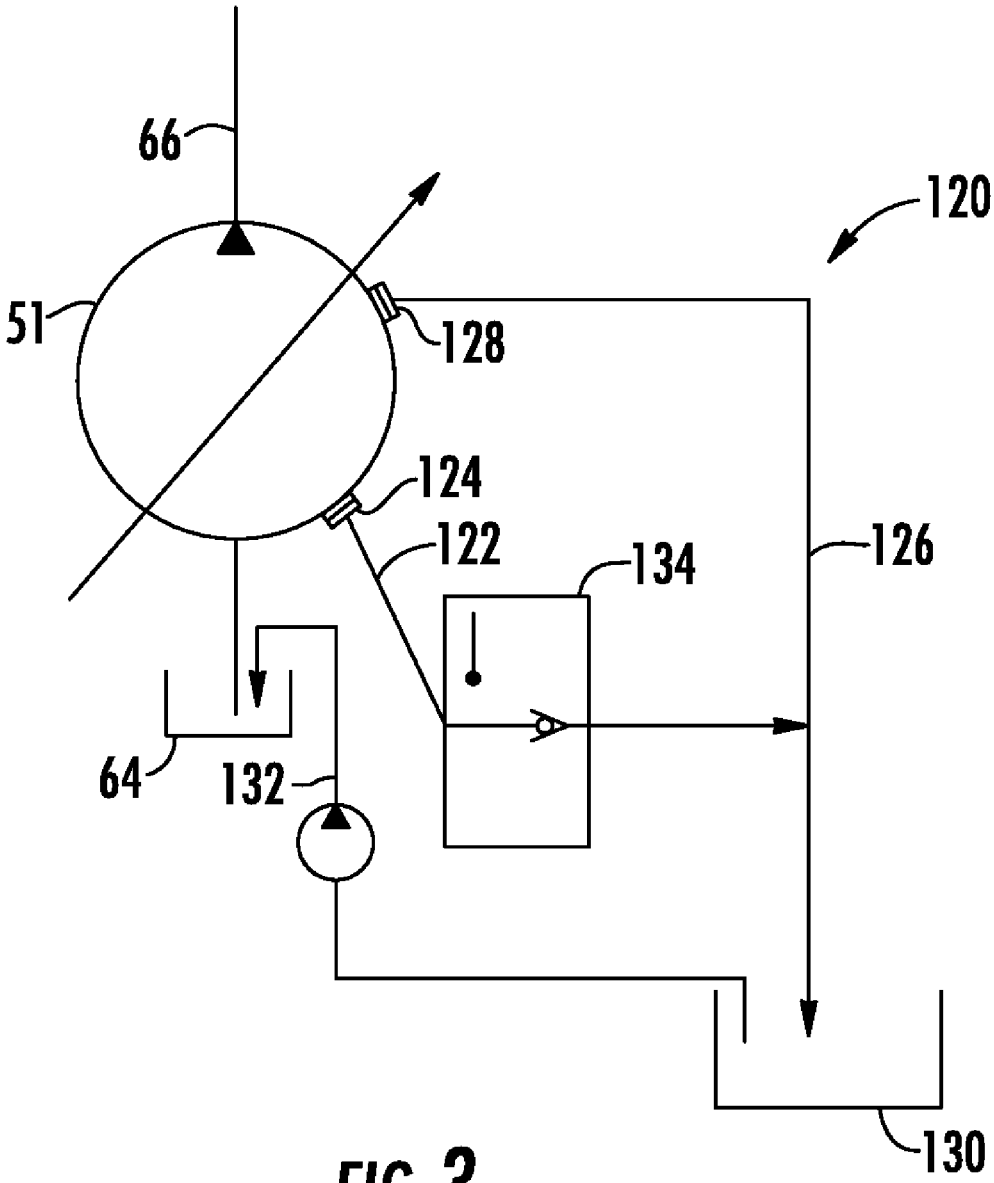
FIG. 3 is a schematic illustration of an exemplary pump casing drainage system useful in the exemplary disclosed machine control system to reduce torque drag of hydraulic pumps during low temperature start-up.

Referring jointly to FIGS. 2 and 3, the first hydraulic pump 51 and/or the second hydraulic pump 53 may be operatively connected to a pump casing drainage system 120 (FIG. 3) which may be activated to drain stored hydraulic fluid or other fluid out of the casing of the hydraulic pumps prior to activation of a starter during start-up of the power source 18. Activation of the pump casing drainage system 120 permits hydraulic fluid to be removed from covering relation relative to rotating groups or elements or other moving parts within the hydraulic pumps thereby reducing drag torque during start-up. This reduction in torque drag within the hydraulic pumps provides a corresponding reduction in the burden on the starter during the starting sequence. This reduction in torque drag may be effected without requiring adjustment of the output provided by the hydraulic pumps.

In accordance with the present disclosure, the pump casing drainage system 120 (FIG. 3) may be activated in response to low temperature environmental conditions corresponding to increased viscosity of the fluid in the first hydraulic pump 51 and/or the second hydraulic pump 53. As shown schematically in FIG. 3, one arrangement for a pump casing drainage system 120 may include a lower casing drain line 122 operatively connected to a lower casing drain port 124 and an upper casing drain line 126 operatively connected to an upper casing drain port 128. In the exemplary arrangement, the lower casing drain line 122 is normally closed, while the upper casing drain line 126 is normally open and operates as an overflow outlet to avoid over pressuring the pump casing. Hydraulic fluid is typically introduced into the pump casing and around rotating groups or elements by leakage from compression chambers within the hydraulic pumps. The hydraulic fluid thereafter acts as a lubricant within the hydraulic pump. As leakage into the pump casing continues, the level of the hydraulic fluid increases until reaching the level of the upper casing drain port 128. Once fluid levels reach the upper casing drain port 128, excess fluid is carried away through the upper casing drain line by gravity and/or pumps (not shown) for transfer to a drainage sump 130. The fluid expelled to the drainage sump 130 may thereafter be pumped back to the tank 64 along a return line 132 for subsequent reuse. Using this arrangement, the pump casing normally retains a substantial level of fluid even after pumping ceases.

Figure 4:
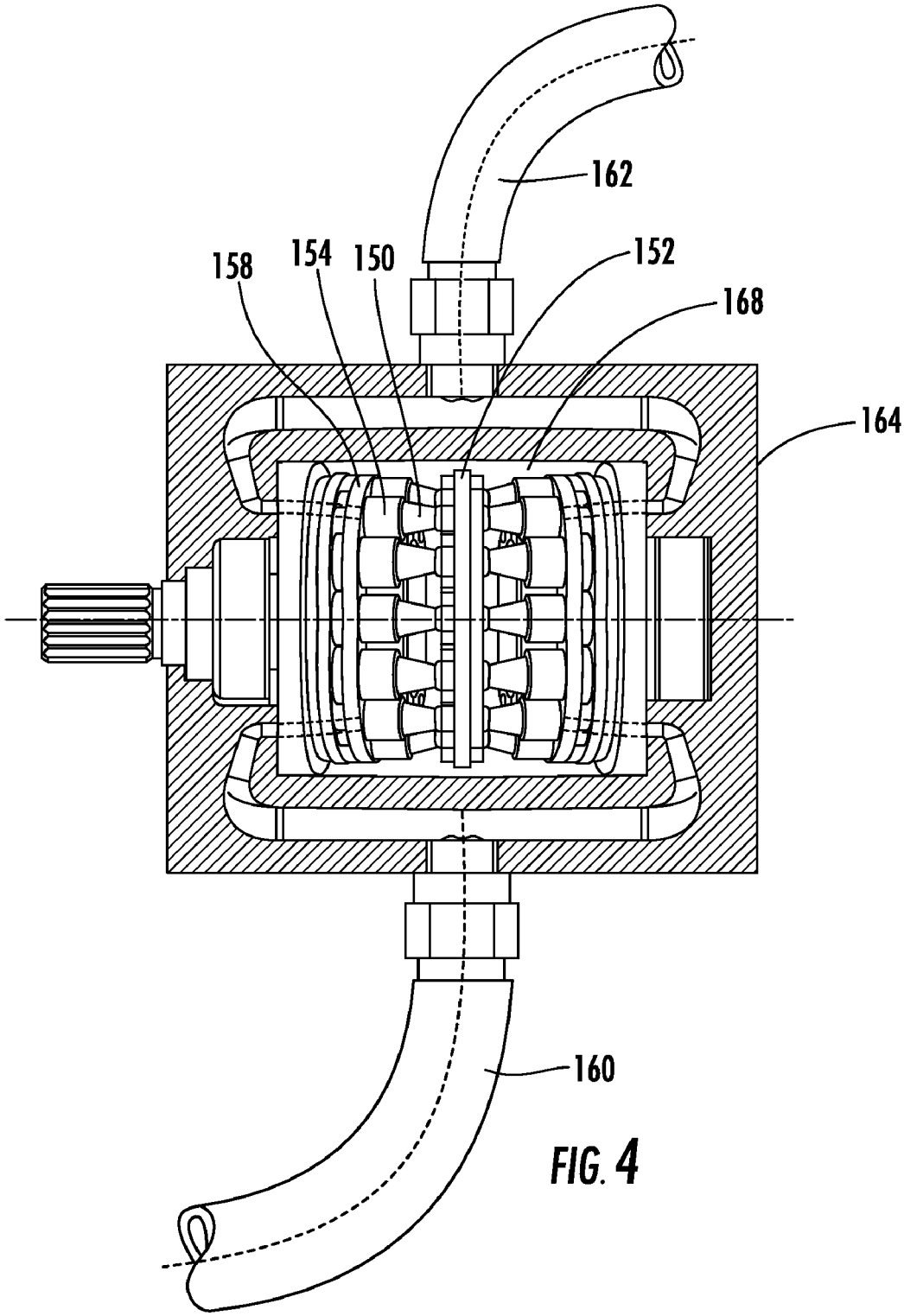
FIG. 4 is a cut-away view of an exemplary rotating piston pump useful in the exemplary disclosed machine control system.

By way of example only, FIG. 4 illustrates the interior of a typical rotating piston pump as may be utilized for the first hydraulic pump 51 and/or the second hydraulic pump 52. As shown, in this exemplary construction, pistons 150 are mounted on either side of a rotor 152. The pistons 150 project outwardly to engage cup elements 154 projecting inwardly from a rotatable drum sleeve 158. The rotor 152 rotates about a first axis while the drum sleeve 158 rotates about a second axis in angled relation to the first axis thereby causing the cup elements 154 to reciprocate relative to the pistons 150 during the rotational cycle. Due to this reciprocating relation, hydraulic fluid may enter through a low pressure line 160 for pressurization and discharge through a high pressure line 162. As shown, a pump casing 164 may surround the various rotating structures with the space between the rotating structures and the pump casing 164 defining an interior cavity 168. During operation, the interior cavity 168 is normally filled with residual hydraulic fluid or other lubricating liquid so as to cover portions of the rotating structures. As noted previously, in the event that the lubricating liquid is hydraulic fluid, leakage from around the interface between the pistons 150 and the cup elements 154 may be used to fill the interior cavity 168, although an independent fill port (not shown) may also be used if desired.

While the presence of hydraulic fluid within the pump casing may be beneficial to provide lubrication during steady state operations, such fluid may also increase the torque drag of the pumps. This increase in torque drag may be particularly acute when the hydraulic fluid is at a reduced temperature such as at start-up in cold environmental conditions. To address such increased torque drag, the exemplary pump casing drainage system 120 utilizes the selective opening of the lower casing drain line 122 to substantially drain retained fluid from the pump casing prior to start-up and to maintain such a drained condition for a period following start-up until the temperature of the system increases to a level providing desired viscosity ratings within the hydraulic fluid.

In the exemplary arrangement of FIG. 3, a selectively activatable flow control member in the form of a temperature activated check valve 134 or other selectively activated device is disposed within the lower casing drain line 122 to normally block fluid communication between the lower casing drain line 122 and a leg of the upper casing drain line 126 feeding into the drainage sump 130. Thus, under normal conditions, wherein the temperature of the hydraulic fluid within the pump casing is above a pre-established level, the temperature activated check valve 134 is in a seated condition thereby providing a dead end to the lower casing drain line and blocking flow from the lower casing drain port 124. However, in the event that the temperature of the hydraulic fluid within the pump casing is below a pre-established limit, the temperature activated check valve 134 is unseated, thereby establishing an open fluid communication channel between the lower casing drain line 122 and the leg of the upper casing drain line 126 feeding into the drainage sump 130. In this open condition, gravity feed causes any fluid above the lower casing drain port 124 to flow out of the pump casing and through the lower casing drain line for collection in the drainage sump 130. If desired, the lower casing drain port 124 may be positioned to permit a portion of the fluid to be retained in the pump casing 164 at a controlled level to provide lubrication during startup. Alternatively, the lower casing drain port 124 may be positioned to facilitate substantially complete drainage of fluid from the pump casing 164 if desired.

By way of example only, the temperature activated check valve 134 may be similar to a common engine coolant thermostat wherein the melting and expansion of a wax pellet is used to change the flow condition of the valve. In this regard, in order to block the flow of hydraulic fluid at higher operating temperatures, the melting of the wax pellet may be used to initiate closure of the temperature activated check valve 134 with cooling and resolidification of the wax causing the temperature activated check valve 134 to reopen. Of course, any number of other temperature dependent valve arrangements as may be known to those of skill in the art may likewise be utilized if desired.

A temperature activated check valve 134 that is not dependent upon a power source for operation may be desirable in some environments of use. By way of example, the use of a wax pellet thermostat or other configuration that operates by thermal activation due to differential expansion or contraction of materials may permit the temperature activated check valve 134 to act in direct response to a reduction in fluid temperature within the pump casing even when the machine 10 is shut down. This ensures that the start-up will not take place with low temperature fluid in the pump casing. Such temperature activated check valves also permit the direct real-time monitoring of the fluid temperature within the pump casing to permit a shut off of the valve and refilling of the pump casing as soon as temperatures of the fluid reach a suitable level thereby minimizing the time without surrounding lubrication. Of course, it is also contemplated that remote monitoring of fluid temperature such as by a hydraulic temperature sensor at the tank 64 may be utilized to provide an operating signal to the temperature activated check valve 134 if desired.

Figure 5:
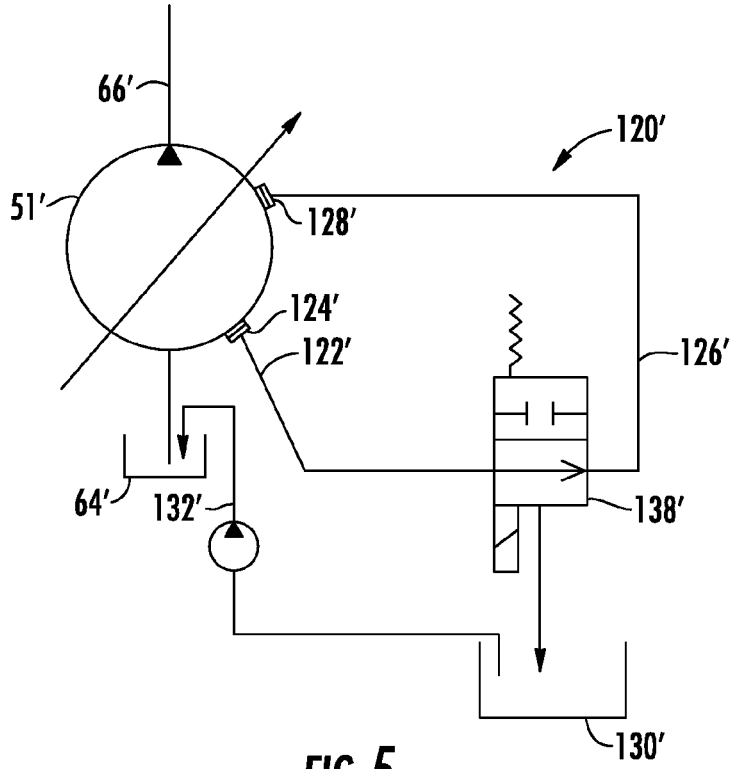
FIG. 5 is a schematic illustration of another exemplary pump casing drainage system useful in the exemplary disclosed machine control system to reduce torque drag of hydraulic pumps during low temperature start-up.

FIG. 5 illustrates another exemplary arrangement for a pump casing drainage system 120' wherein elements previously described are designated by like reference numerals with a prime. As shown, in the arrangement of FIG. 5, the lower casing drain line 122' and the upper casing drain line 126' feed to a common two-way electronically controlled directional valve 138' disposed upstream from the drainage sump 130'. In this configuration, the electronically controlled directional valve 138' may be operated based on a sensed temperature measurement of fluid within the pump casing or may rely on a signal from a remote measurement device such as a hydraulic temperature sensor or the like located at any convenient position within the system. As an alternative to an electrical signal, the two-way valve may incorporate a pneumatic or hydraulic pilot if desired.

Figure 6:
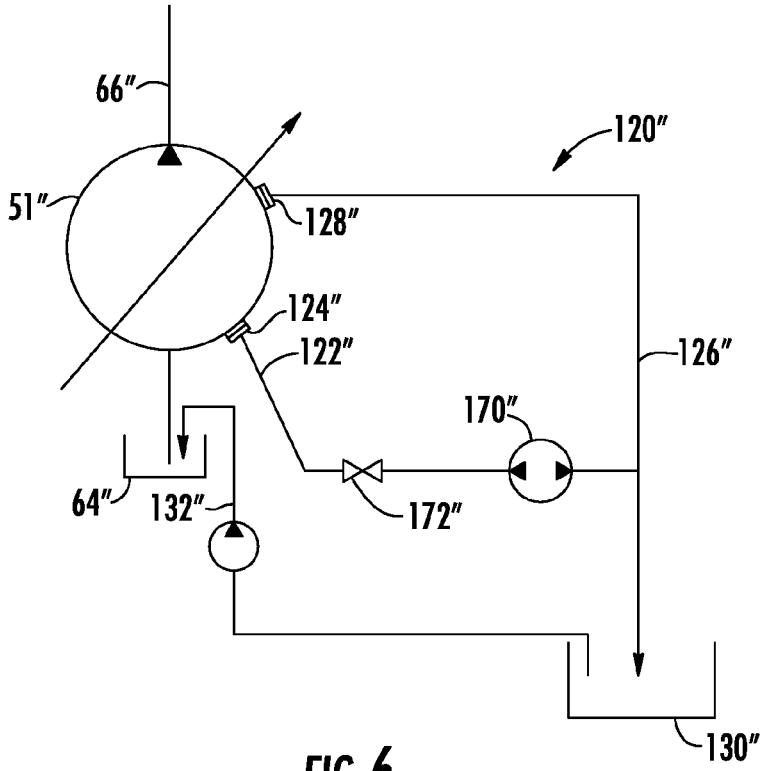
FIG. 6 is a schematic illustration of another exemplary pump casing drainage system useful in the exemplary disclosed machine control system to reduce torque drag of hydraulic pumps during low temperature start-up.

FIG. 6 illustrates yet another exemplary arrangement for a pump casing drainage system 120" wherein elements previously described are designated by like reference numerals with a double prime. As shown, in the arrangement of FIG. 6, the lower casing drain line 122" feeds to a two way pump 170" with an optional upstream valve 172". In this embodiment, the two way pump 170" may be used to drain the pump casing prior to activation of the hydraulic pump 51" in response to the temperature dropping below a certain level. The two way pump 170" may then be reversed following start-up to return hydraulic fluid or other lubricating liquid back to the pump casing for continued operation. Thus, in this embodiment, the two way pump 170" acts as a selectively activatable flow control member controlling flow of lubricating liquid out of the pump casing. If desired, the optional upstream valve 172" may be used to aid in blocking flow out of the pump casing during normal operation. If desired, the two way pump 170" may be positioned in elevated relation to the lower casing drain port 124". Such elevated positioning may aid in avoiding unintentional draining across the two way pump 170". While the use of the two way pump 170" may be beneficial in some applications. It is also contemplated that a one-way pump may be used if desired with refilling carried out along the return line 132" during pumping of the hydraulic fluid as previously described.

It is to be understood that while pump casing drainage systems consistent with this disclosure may be selectively activated based upon temperature levels of the hydraulic fluid or other lubricating liquid, such drainage systems may likewise be activated automatically without reference to such temperature conditions. By way of example only, any of the flow control members controlling drainage of the pump casing 164 may be set to automatically drain or partially drain the pump casing 164 following machine shut-down or at some time thereafter without regard to temperature. This provides a default status of start-up with at least a partially drained pump casing 164 thereby ensuring a reduction in torque drag during start-up.

INDUSTRIAL APPLICABILITY

The disclosed machine hydraulic pump system may be applicable to any machine that includes one or more hydraulic pumps utilizing rotating groups or other moving parts that are normally surrounded with lubricating liquid contained within a housing chamber external to compression chambers within the pumps. The disclosed machine hydraulic pump system may be used to selectively drain lubricating fluid out of the pump casings prior to activation of a starter and to maintain that drained relation until fluid within the pump casing reaches a desired temperature. Added strain on the starter caused by fluid within the pump casing is thereby avoided.

Once the fluid reaches a desired temperature, draining may be terminated thereby allowing the pump casing to be refilled and operated normally. No adjustment of pumping output is required.

A machine hydraulic pump system consistent with the present disclosure may find application in any number machines incorporating hydraulic control systems utilizing one or more hydraulic pumps. Such a machine hydraulic pump system may be particularly beneficial for use in machines subject to consistent or intermittent low temperatures which serve to increase the viscosity of lubricating fluid surrounding moving parts within the hydraulic pumps.

It will be appreciated that the foregoing description provides examples of the disclosed system and technique. However, it is contemplated that other implementations of the disclosure may differ in detail from the foregoing examples. All references to examples herein are intended to reference the particular example being discussed at that point and are not intended to imply any limitation as to the scope of the disclosure or claims more generally. All language of distinction and disparagement with respect to certain features is intended to indicate a lack of preference for those features, but not to exclude such from the scope of the claims entirely unless otherwise indicated. All methods described herein can be performed in any suitable order unless otherwise indicated herein or otherwise clearly contradicted by context. Moreover, any combination of the above-described elements in all possible variations thereof is contemplated unless otherwise indicated herein or otherwise clearly contradicted by context.

What is claimed is:

1. A machine hydraulic pump system, comprising:

at least one hydraulic pump having an inlet fluidly connected to a drainage sump, the at least one hydraulic pump driven to pressurize a hydraulic fluid provided from the drainage sump and configured to circulate said pressurized hydraulic fluid through a hydraulic circuit, said at least one hydraulic pump including a pump casing defining an interior cavity adapted to hold a lubricating liquid, said lubricating liquid having a temperature;

an upper drain port fluidly connecting the interior cavity with the drainage sump such that said lubricating liquid at an overflow level in the interior cavity drains to the drainage sump;

a lower drain port in fluid communication with said interior cavity, the lower drain port disposed to fluidly connect the interior cavity with the drainage sump such that said lubricating liquid at a lower fluid level, which is below the overflow level, drains to the drainage sump; and a selectively activatable flow control member disposed in operative relation to said lower drain port, said selectively activatable flow control member adapted to move from a fluid containment condition to a fluid withdrawal condition in response to said temperature dropping below a predefined lower limit to at least partially evacuate said lubricating liquid from said interior cavity to the drainage sump prior to startup of said at least one hydraulic pump.

2. The machine hydraulic pump system as recited in claim 1, wherein said selectively activatable flow control member is a thermally activated check valve.

3. The machine hydraulic pump system as recited in claim 1, wherein said selectively activatable flow control member is an electronically controlled directional valve.

4. The machine hydraulic pump system as recited in claim 1, wherein said selectively activatable flow control member is a pump.

5. The machine hydraulic pump system as recited in claim 1, wherein said at least one hydraulic pump is a rotating piston pump.

6. The machine hydraulic pump system as recited in claim 1, wherein said lubricating liquid consists essentially of said hydraulic fluid.

7. The machine hydraulic pump system as recited in claim 6, wherein said selectively activatable flow control member is disposed at a position below said lower drain port, such that said lubricating liquid flows by gravity away from said at least one hydraulic pump when said selectively activatable flow control member is in said fluid withdrawal condition.

8. The machine hydraulic pump system as recited in claim 7, further comprising a return line providing fluid communication between the drainage sump and a tank storing said hydraulic fluid.

9. A machine hydraulic pump system, comprising:

at least one hydraulic pump having an inlet fluidly connected to a drainage sump, the at least one hydraulic pump driven to pressurize a hydraulic fluid provided from the drainage sump and configured to circulate said pressurized hydraulic fluid through a hydraulic circuit, said at least one hydraulic pump including a pump casing defining an interior cavity adapted to hold a lubricating liquid, said lubricating liquid having a temperature;

a lower casing drain line operatively connected to a lower casing drain port in fluid communication with said interior cavity, the lower casing drain port disposed to fluidly connect the interior cavity with the drainage sump such that said lubricating liquid at a lower fluid level can be drained from the interior cavity;

an upper casing drain line operatively connected to an upper casing drain port in fluid communication with said interior cavity, the upper casing drain port disposed to fluidly connect the interior cavity with the drainage sump such that said lubricating liquid at an overflow level, which is higher than the lower fluid level, can be drained from the interior cavity, said upper casing drain port being disposed in elevated relation relative to said lower casing drain port;

a selectively activatable flow control member disposed in flow-controlling relation to said lower casing drain line, said selectively activatable flow control member being adapted to move from a fluid containment condition to a fluid withdrawal condition in response to said temperature dropping below a predefined lower limit to at least partially evacuate said lubricating liquid from said interior cavity to the drainage sump prior to startup of said at least one hydraulic pump.

10. The machine hydraulic pump system as recited in claim 9, wherein said selectively activatable flow control member is a thermally activated check valve.

11. The machine hydraulic pump system as recited in claim 9, wherein said selectively activatable flow control member is an electronically controlled directional valve.

12. The machine hydraulic pump system as recited in claim 9, wherein said selectively activatable flow control member is a pump.

13. The machine hydraulic pump system as recited in claim 9, wherein said at least one hydraulic pump is a rotating piston pump.

14. The machine hydraulic pump system as recited in claim 9, wherein said lubricating liquid consists essentially of said hydraulic fluid.

15. The machine hydraulic pump system as recited in claim 14, wherein said selectively activatable flow control member is disposed at a position below said lower casing drain port, such that said lubricating liquid flows by gravity away from said at least one hydraulic pump to the drainage sump when said selectively activatable flow control member is in said fluid withdrawal condition.

16. The machine hydraulic pump system as recited in claim 15, further comprising a return line providing fluid communication between said drainage sump and a tank storing said hydraulic fluid.

17. A method of reducing torque drag during start-up of in a machine hydraulic pump system having at least one hydraulic pump having an inlet fluidly connected to a drainage sump, the at least one hydraulic pump driven to pressurize a hydraulic fluid provided from the drainage sump and configured to circulate said pressurized hydraulic fluid through a hydraulic circuit, said at least one hydraulic pump including a pump casing defining an interior cavity adapted to hold a lubricating liquid, said at least one hydraulic pump including an upper drain port configured to drain said lubricating liquid at an overflow level from the interior cavity to the drainage sump, and a lower drain port configured to drain said lubricating liquid at a lower level from the interior cavity to the drainage sump, the method comprising;

selectively moving a flow control member disposed in flow-controlling relation to said lower drain port from a fluid containment condition to a fluid withdrawal condition prior to startup of said at least one hydraulic pump to at least partially evacuate said lubricating liquid from said interior cavity to the drainage sump;

starting said at least one hydraulic pump without replacing the lubricating liquid evacuated from said pump casing; and selectively returning said flow control member to the fluid containment condition subsequent to said lubricating liquid being at least partially evacuated from said interior cavity to the drainage sump.

18. The method as recited in claim 17, wherein said flow control member is a thermally activated check valve.

19. The method as recited in claim 17, wherein said flow control member is an electronically controlled directional valve.

20. The method as recited in claim 17, wherein said flow control member is a pump.

* * * * *